US006192522B1

(12) United States Patent
Schreib

(10) Patent No.: US 6,192,522 B1
(45) Date of Patent: Feb. 27, 2001

(54) PANTS WITH CROTCH COVERING FLAP ASSEMBLY

(76) Inventor: Gary A. Schreib, 11619 213 Ave. Ct. E, Bonney Lake, WA (US) 98390

( * ) Notice: Subject to any disclaimer, the term of this patent is extended or adjusted under 35 U.S.C. 154(b) by 0 days.

(21) Appl. No.: 09/397,252

(22) Filed: Sep. 16, 1999

(51) Int. Cl.[7] ..... A41D 1/06
(52) U.S. Cl. ..... 2/227; 2/69; 2/79
(58) Field of Search ..... 2/227, 228, 238, 2/234, 400–408, 69, 70, 79, 80, 83

(56) References Cited

U.S. PATENT DOCUMENTS

| | | | | |
|---|---|---|---|---|
| D. 359,609 | | 6/1995 | Deslippe . | |
| 2,519,202 | * | 8/1950 | Slater | 2/227 |
| 2,548,660 | | 4/1951 | Feldman . | |
| 2,812,516 | * | 11/1957 | Hoffman | 2/80 |
| 3,154,082 | | 10/1964 | Cape . | |
| 3,425,063 | * | 2/1969 | Brown | 2/227 |
| 4,578,828 | * | 4/1986 | Smith, Sr. et al. | 2/234 |
| 4,604,761 | | 8/1986 | Wright . | |
| 5,010,595 | * | 4/1991 | Stadley | 2/227 |
| 5,014,364 | | 5/1991 | Orr . | |
| 5,539,926 | * | 7/1996 | Mantos | 2/228 |
| 5,790,984 | * | 8/1998 | Doubleday | 2/69 |
| 5,983,401 | * | 11/1999 | Ohara | 2/227 |

FOREIGN PATENT DOCUMENTS

| | | | | |
|---|---|---|---|---|
| 1523226 | * | 2/1967 | (FR) | 2/227 |
| WO98/07339 | * | 2/1998 | (WO) | 2/227 |

* cited by examiner

*Primary Examiner*—Gloria M. Hale

(57) ABSTRACT

A pair of pants having a crotch covering flap assembly for permitting a female to expose the crotch area to permit unobstructed urination without removing the pants includes pants having an overlapping pair of material portions for covering the crotch of a user and a fastening assembly for selectively coupling the material portions to each other for covering the crotch of the user.

10 Claims, 3 Drawing Sheets

PANTS WITH CROTCH COVERING FLAP ASSEMBLY

BACKGROUND OF THE INVENTION

1. Field of the Invention

The present invention relates to pants and more particularly pertains to a new pair of pants having a crotch covering flap assembly for permitting a female to expose the crotch area to permit unobstructed urination without removing the pants.

2. Description of the Prior Art

The use of pants is known in the prior art. More specifically, pants heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,010,595; U.S. Pat. No. 4,604,761; U.S. Pat. No. Des. 359,609; U.S. Pat. No. 5,014,364; U.S. Pat. No. 3,154,082; and U.S. Pat. No. 2,548,660.

While these devices fulfill their respective, particular objectives and requirements, the aforementioned patents do not disclose a new pair of pants having a crotch covering flap assembly. The inventive device includes pants having an overlapping pair of material portions for covering the crotch of a user and a fastening assembly for selectively coupling the material portions to each other for covering the crotch of the user.

In these respects, the pants having a crotch covering flap assembly according to the present invention substantially departs from the conventional concepts and designs of the prior art, and in so doing provides an apparatus primarily developed for the purpose of permitting a female to expose the crotch area to permit unobstructed urination without removing the pants.

SUMMARY OF THE INVENTION

In view of the foregoing disadvantages inherent in the known types of pants now present in the prior art, the present invention provides a new pair of pants having a crotch covering flap assembly construction wherein the same can be utilized for permitting a female to expose the crotch area to permit unobstructed urination without removing the pants.

The general purpose of the present invention, which will be described subsequently in greater detail, is to provide a new pair of pants having a crotch covering flap assembly apparatus and method which has many of the advantages of the pants mentioned heretofore and many novel features that result in a new pair of pants having a crotch covering flap assembly which is not anticipated, rendered obvious, suggested, or even implied by any of the prior art pants, either alone or in any combination thereof.

To attain this, the present invention generally comprises pants having an overlapping pair of material portions for covering the crotch of a user and a fastening assembly for selectively coupling the material portions to each other for covering the crotch of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pair of pants having a crotch covering flap assembly apparatus and method which has many of the advantages of the pants mentioned heretofore and many novel features that result in a new pair of pants having a crotch covering flap assembly which is not anticipated, rendered obvious, suggested, or even implied by any of the prior art pants, either alone or in any combination thereof.

It is another object of the present invention to provide a new pair of pants having a crotch covering flap assembly that may be easily and efficiently manufactured and marketed.

It is a further object of the present invention to provide a new pair of pants having a crotch covering flap assembly that is of a durable and reliable construction.

An even further object of the present invention is to provide a new pair of pants having a crotch covering flap assembly which is susceptible of a low cost of manufacture with regard to both materials and labor, and which accordingly is then susceptible of low prices of sale to the consuming public, thereby making such pants having a crotch covering flap assembly economically available to the buying public.

Still yet another object of the present invention is to provide a new pair of pants having a crotch covering flap assembly which provides in the apparatuses and methods of the prior art some of the advantages thereof, while simultaneously overcoming some of the disadvantages normally associated therewith.

Still another object of the present invention is to provide a new pair of pants having a crotch Covering flap assembly for permitting a female to expose the crotch area to permit unobstructed urination without removing the pants.

Yet another object of the present invention is to provide a new pair of pants having a crotch covering flap assembly which includes pants having an overlapping pair of material portions for covering the crotch of a user and a fastening assembly for selectively coupling the material portions to each other for covering the crotch of the user.

Still yet another object of the present invention is to provide a new pair of pants having a crotch covering flap assembly that is easily unfastened to facilitate exposure of the crotch.

Even still another object of the present invention is to provide a new pair of pants having a crotch covering flap assembly that is positioned to permit unobstructed urination by a female user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
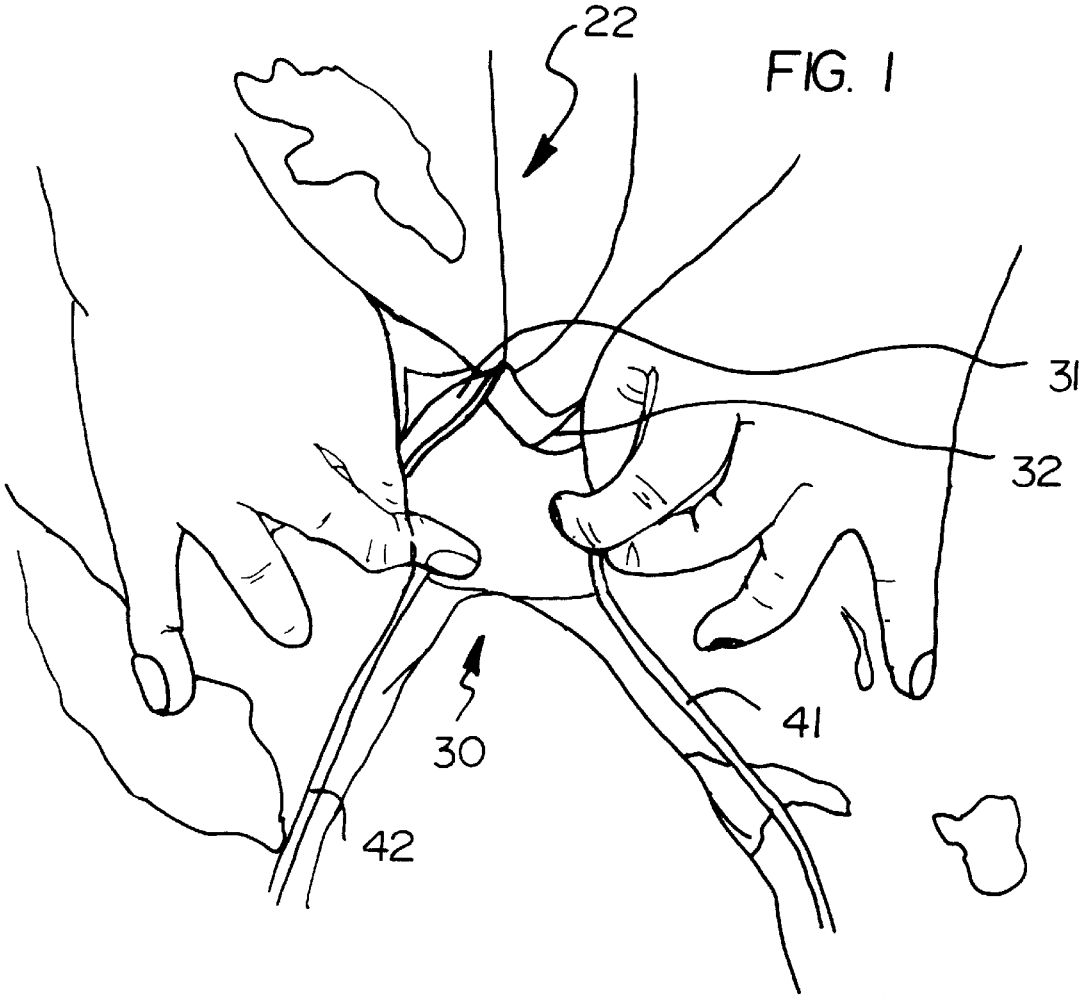
FIG. 1 is a perspective in use view of a new pair of pants having a crotch covering flap assembly according to the present invention.
Figure 2:
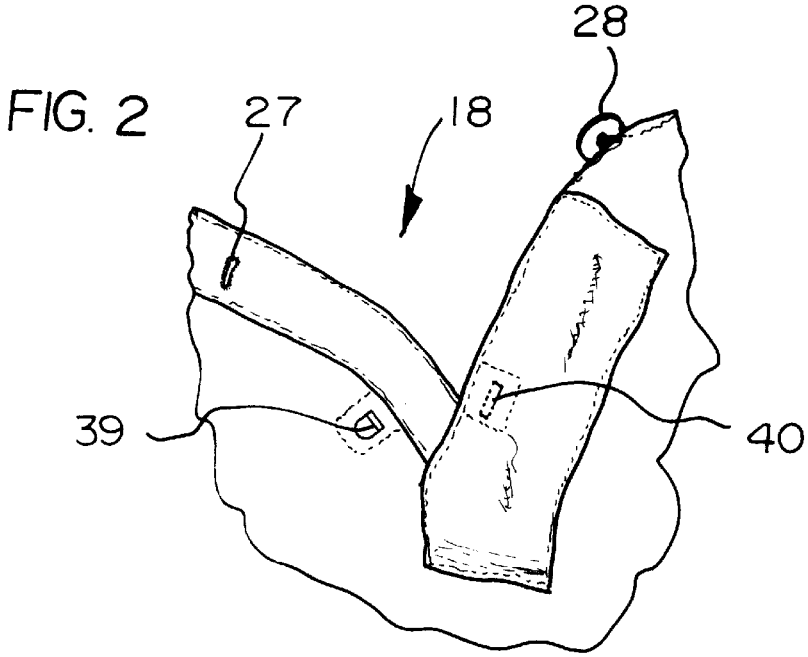
FIG. 2 is a front view of the groin slit portion of the present invention.
Figure 3:
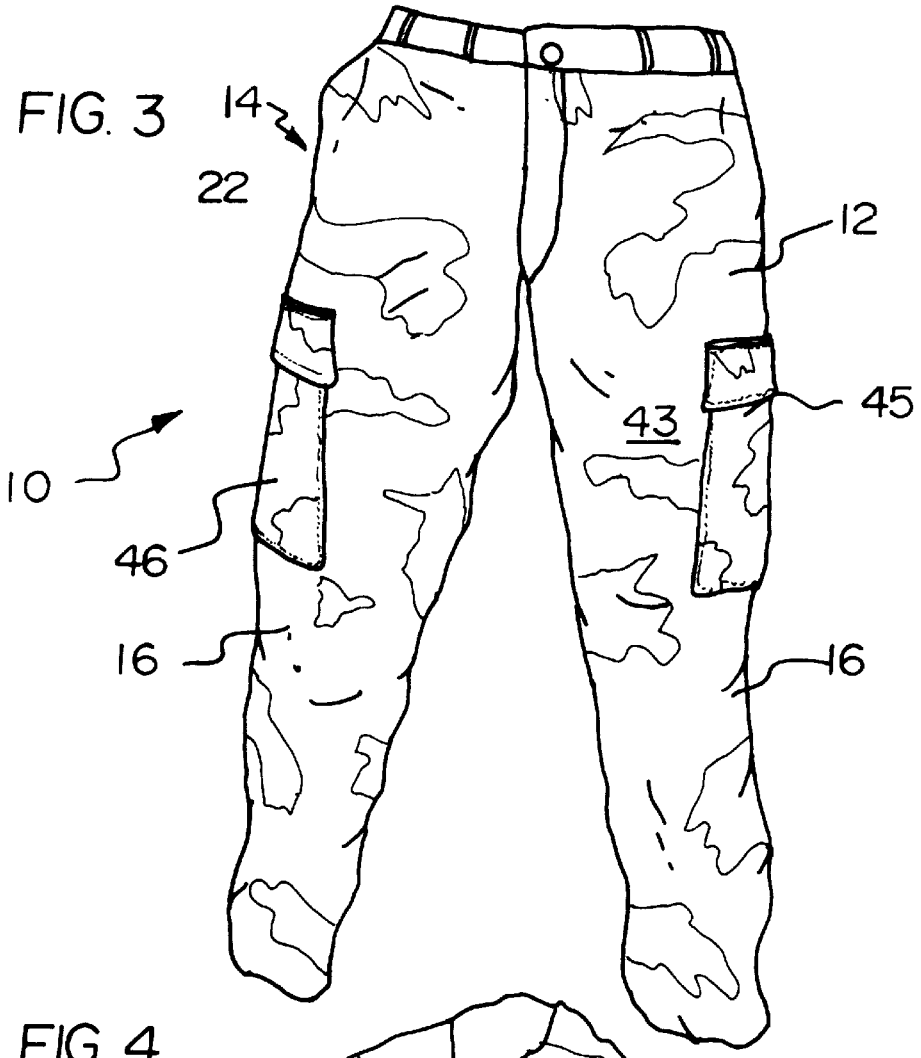
FIG. 3 is a front view of the present invention.
Figure 4:
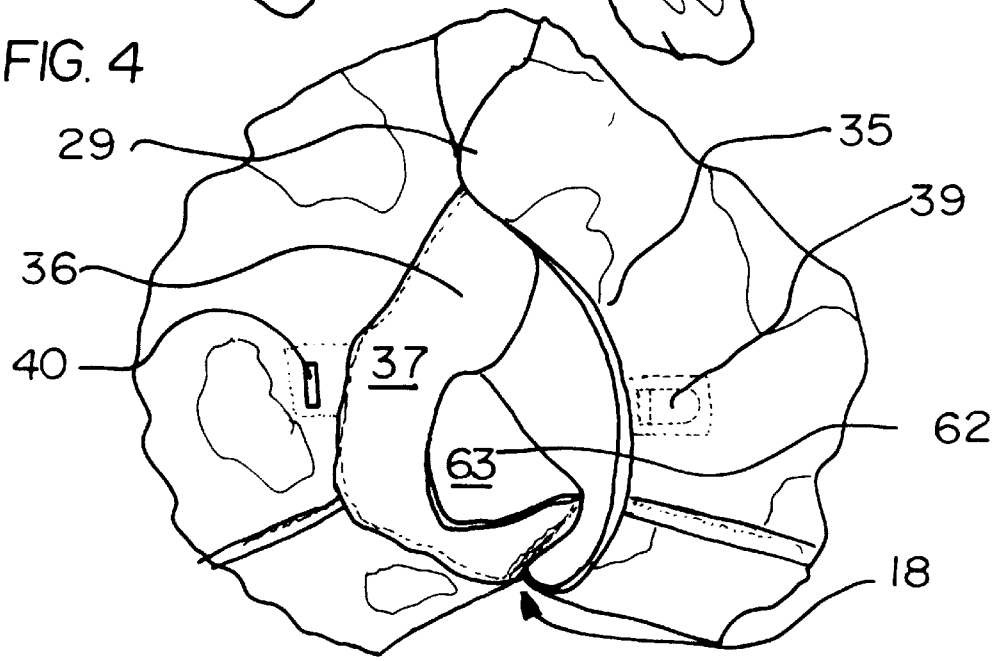
FIG. 4 is a front view of the crotch portion of the present invention.
Figure 5:
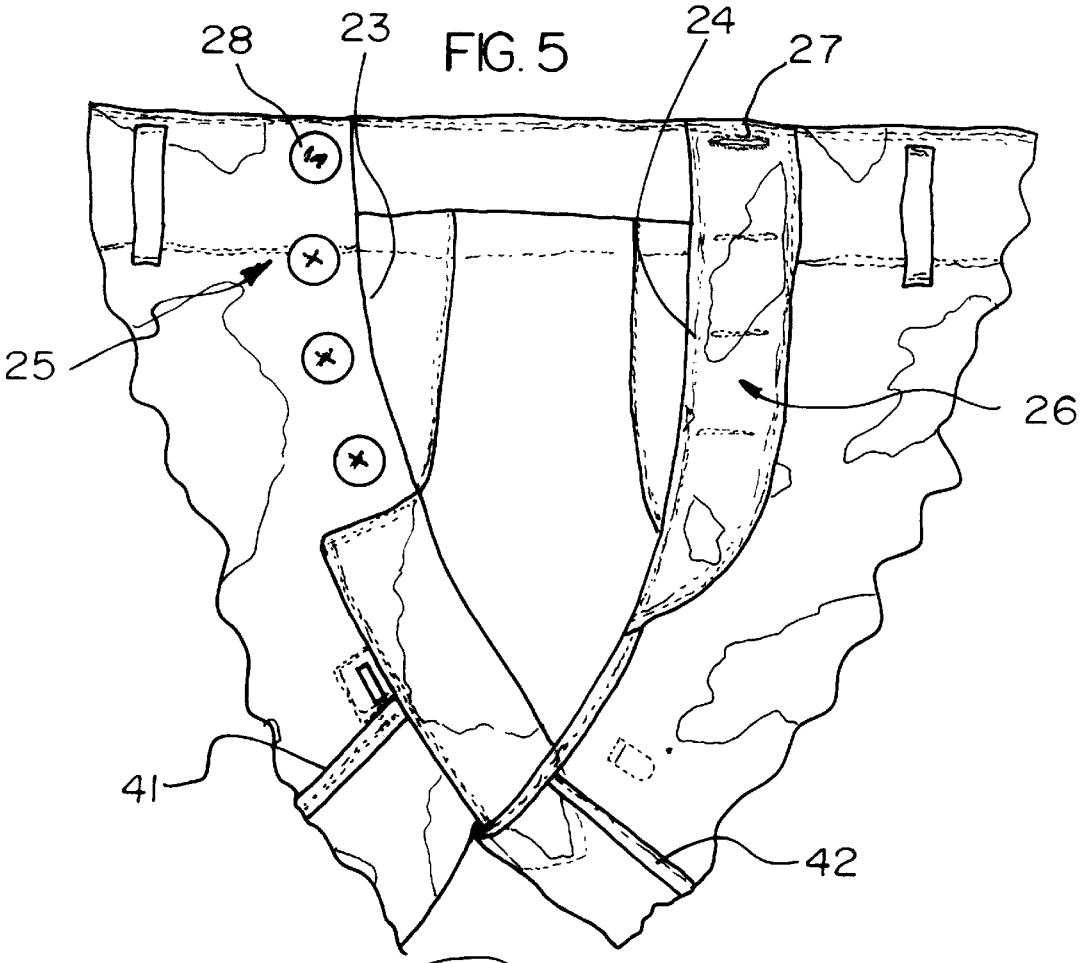
FIG. 5 is a front view of the slit of the present invention.
Figure 6:
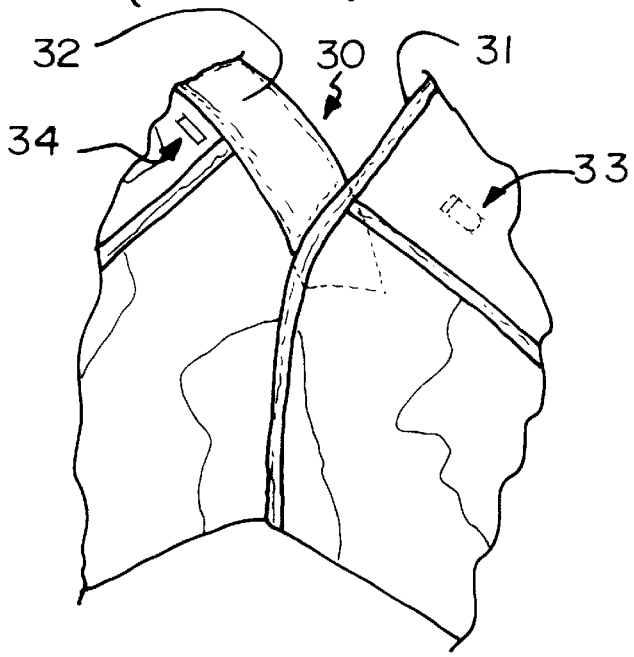
FIG. 6 is a front view of the crotch portion of the present invention.

With reference now to the drawings, and in particular to FIGS. 1 through 6 thereof, a new pair of pants having a crotch covering flap assembly embodying the principles and concepts of the present invention and generally designated by the reference numeral 10 will be described.

As best illustrated in FIGS. 1 through 6, the pants having a crotch covering flap assembly 10 generally comprises a pair of pants 12 having a pelvic covering portion 14, a pair of legs 16 extending downwardly from the pelvic covering portion, and a crotch portion 18 positioned at a base of the pelvic covering portion and between the pair of legs.

A slit 20 extends through a front of the pelvic covering portion and into the crotch portion. The slit may extend partially or entirely across the crotch portion as desired for ease of use. An upper portion of the slit defines a fly portion 22 that has opposite sides 23 and 24. The fly portion is designed for facilitating putting on and taking off of the pants by the user.

A pair of complementary fly fastening portions 25 and 26 are positioned on the opposite sides of the fly portion for selectively coupling the opposite sides of the fly portion together. The fly fastening portions may include a line of button holes 27 and a complementary line of buttons 28. Each button 28 is positioned to engage an associated one of the button holes 27. In an embodiment, a zipper may be used and a base 29 of the fly portion may be stitched together.

A lower portion of the slit extends from the base of the fly portion through the crotch portion to define a groin slit portion 30 that has opposite sides 31 and 32. A pair of complementary groin slit fastening members 33 and 34 are positioned on the opposite sides of the groin slit portion for selectively permitting uncoupling of the opposite sides 31 and 32 to permit unobstructed urination by a female wearer of the pants while the pants are being worn.

In an embodiment, the opposite sides 31 and 32 overlap each other such that one of the opposite sides forms an outer flap 35 and the other of the sides forms an inner flap 36.

One of the groin slit fastening members 33 or 34 is coupled to a front face 37 of the inner flap and the complementary other of the groin slit fastening members 33 or 34 is coupled to a rear face 38 of the outer flap such that the rear face of the outer flap is positioned adjacent the front face of the inner flap when the groin slit fastening members are coupled to each other. In an embodiment, the groin slit fastening members comprise a hook 39 and eye 40. The hook is coupled to extend outwardly from the rear face of the outer flap and the eye is coupled to extend outwardly from the front face of the inner flap to permit engagement of the hook to the eye such that the groin slit portion is held in a closed position. In an embodiment, the hook and the eye are each positioned proximate a respective inseam 41 and 42 of an associated one of the pair of legs.

The pair of pants optionally includes a camouflage pattern on an outer surface 43 of the pair of pants for use while hunting or birdwatching or the like, when the user is outdoors and lavatory facilities are not readily available. A pair of pockets 45 and 46 are each coupled to an associated one of the pair of legs for providing additional carrying space.

An interior lining 62 is coupled to a rear face 63 of the inner flap such that the interior lining is designed for positioning adjacent the crotch of the wearer. The interior lining is most preferably constructed of a soft absorbent material for facilitating comfort of the wearer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment comprising:

a pair of pants having a pelvic covering portion, a pair of legs extending downwardly from the pelvic covering portion, and a crotch portion positioned at a base of the pelvic covering portion and between the pair of legs;

a continuous slit extending from a top edge of said pelvic covering portion through a front of said pelvic covering portion and into said crotch portion, an upper portion of said slit defining a fly portion, said fly portion having opposite sides, said fly portion being for facilitating putting on and taking off of the pants by a user;

a pair of complementary fly fastening portions positioned on said opposite sides of said fly portion for selectively coupling said opposite sides of said fly portion together;

a lower portion of said slit extending from a base of said fly portion through said crotch portion to define a groin slit portion, said groin slit portion having opposite sides;

a pair of complementary groin slit fastening members positioned on said opposite sides of said groin slit portion in spaced relationship to a base of said fly fastening portions, said groin slit fastening members being adapted for selectively uncoupling to permit unobstructed urination by a female wearer of the pants while the pants are being worn;

said opposite sides of said groin slit portion overlapping each other such that one of said opposite sides forms an outer flap and the other of said sides forms an inner flap;

a layer of material and a line of stitching extending from an edge of said inner flap to define a reinforced portion of said inner flap for preventing bunching of said inner flap and facilitating holding of said opposite sides of said groin slit portion in a closed position by said single pair of complementary groin slit fastening members; and one of said groin slit fastening members being coupled to a front face of said inner flap such that said reinforced portion of said inner flap is positioned between said one of said groin slit fastening members and an edge of said inner flap, the complementary other of said groin slit fastening members being coupled to a rear face of said outer flap such that said rear face of said outer flap is positioned adjacent said front face of said inner flap when said groin slit fastening members are coupled to each other.

2. The garment of claim 1, wherein the fly fastening portions include a line of button holes and a complementary line of buttons, each button being positioned to engage an associated one of said button holes.

3. The garment of claim 1 wherein said groin slit fastening members comprise a hook and eye.

4. The garment of claim 3 wherein said hook is coupled to extend outwardly from said rear face of said outer flap and said eye is coupled to extend outwardly from said front face of said inner flap.

5. The garment of claim 4 wherein said hook and said eye are each positioned proximate a respective inseam of an associated one of said pair of legs.

6. The garment of claim 1 wherein said pair of pants includes a camouflage pattern on an outer surface of said pair of pants.

7. The garment of claim 1, further comprising:

a pair of pockets, each of said pockets being coupled to an associated one of said pair of legs.

8. The garment of claim 1, further comprising:

an interior lining coupled to a rear face of said inner flap such that said interior lining is adapted for positioning adjacent the crotch of the wearer.

9. The garment of claim 8, wherein the interior lining is constructed of a soft material for facilitating comfort of the wearer.

10. A garment for facilitating unobstructed urination by a female while wearing the garment, the garment comprising:

a pair of pants having a pelvic covering portion, a pair of legs extending downwardly from the pelvic covering portion, and a crotch portion positioned at a base of the pelvic covering portion and between the pair of legs;

a continuous slit extending from a top edge of said pelvic covering portion through a front of said pelvic covering portion and into said crotch portion, an upper portion of said slit defining a fly portion, said fly portion having opposite sides, said fly portion being adapted for facilitating putting on and taking off of the pants by a user;

a pair of complementary fly fastening portions positioned on said opposite sides of said fly portion for selectively coupling said opposite sides of said fly portion together;

a lower portion of said slit extending from a base of said fly portion through said crotch portion to define a groin slit portion, said groin slit portion having opposite sides;

a single pair of complementary groin slit fastening members positioned in spaced relationship to a base of said fly fastening portions on said opposite sides of said groin slit portion, said groin slit fastening members being adapted for selectively uncoupling to permit unobstructed urination by a female wearer of the pants while the pants are being worn;

said opposite sides of said groin slit portion overlapping each other such that one of said opposite sides forms an outer flap and the other of said sides forms an inner flap;

a layer of material and a line of stitching extending from an edge of said inner flap to define a generally rectangular reinforced portion of said inner flap for preventing bunching of said inner flap and facilitating holding of said opposite sides of said groin slit portion in a closed position by said single pair of complementary groin slit fastening members;

one of said groin slit fastening members being coupled to a front face of said inner flap such that said reinforced portion of said inner flap is positioned between said one of said groin slit fastening members and an edge of said inner flap, the complementary other of said groin slit fastening members being coupled to a rear face of said outer flap such that said rear face of said outer flap is positioned adjacent said front face of said inner flap when said groin slit fastening members are coupled to each other;

wherein the fly fastening portions include a line of button holes and a complementary line of buttons, each button being positioned to engage an associated one of said button holes;

wherein said groin slit fastening members comprise a hook and eye;

wherein said hook is coupled to extend outwardly from said rear face of said outer flap and said eye is coupled to extend outwardly from said front face of said inner flap;

wherein said hook and said eye are each positioned proximate a respective inseam of an associated one of said pair of legs;

wherein said pair of pants includes a camouflage pattern on an outer surface of said pair of pants;

a pair of pockets, each of said pockets being coupled to an associated one of said pair of legs;

an interior lining coupled to a rear face of said inner flap such that said interior lining is adapted for positioning adjacent the crotch of the wearer; and wherein the interior lining is constructed of a soft material for facilitating comfort of the wearer.

* * * * *